US006969168B2

(12) United States Patent
Mo et al.

(10) Patent No.: US 6,969,168 B2
(45) Date of Patent: Nov. 29, 2005

(54) MEDIA LOADING AND SEPARATION SYSTEM FOR PRINTER

(75) Inventors: Jiangxiao Mo, Vancouver, WA (US); Thomas Wayne Ruhe, La Center, WA (US); Stephen Tse Deng, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/666,717

(22) Filed: Sep. 19, 2003

(65) Prior Publication Data

US 2005/0062825 A1 Mar. 24, 2005

(51) Int. Cl.[7] ..... B65H 3/46

(52) U.S. Cl. ..... 347/104; 271/104; 271/121; 271/137; 271/167; 400/624

(58) Field of Search ..... 271/104, 121, 271/124, 137, 138, 167, 169; 347/104; 400/624, 400/642

(56) References Cited

U.S. PATENT DOCUMENTS

| | | | | |
|---|---|---|---|---|
| 4,887,806 | A * | 12/1989 | Tanaka et al. | 271/121 |
| 5,624,197 | A * | 4/1997 | Morikawa et al. | 400/629 |
| 5,879,003 | A * | 3/1999 | Kovach et al. | 271/121 |
| 5,895,040 | A * | 4/1999 | Oleksa et al. | 271/124 |
| 6,267,371 | B1 * | 7/2001 | Jessop | 271/171 |
| 2004/0032077 | A1 * | 2/2004 | Oh et al. | 271/121 |

FOREIGN PATENT DOCUMENTS

| | | | | |
|---|---|---|---|---|
| JP | 2004269231 | A * | 9/2004 | B65H 1/06 |

* cited by examiner

*Primary Examiner*—Ren Yan
*Assistant Examiner*—Jill E. Culler

(57) ABSTRACT

A media loading and separation system includes a spring pick block with an inclined surface having a lower end; an indentation, formed near the lower end of the inclined surface, having a substantially vertical surface; and a spring arm movably disposed in response to a media stack with respect to the inclined surface between rearward and forward positions. The media separation system can also include a corner media separator to engage a corner of the media stack.

26 Claims, 2 Drawing Sheets

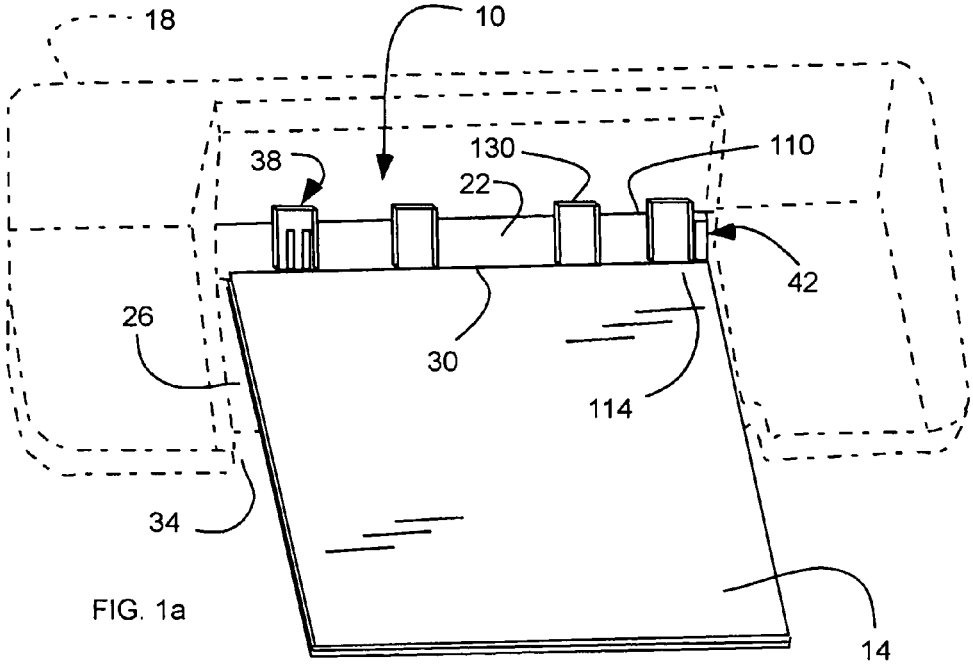
FIG. 1a
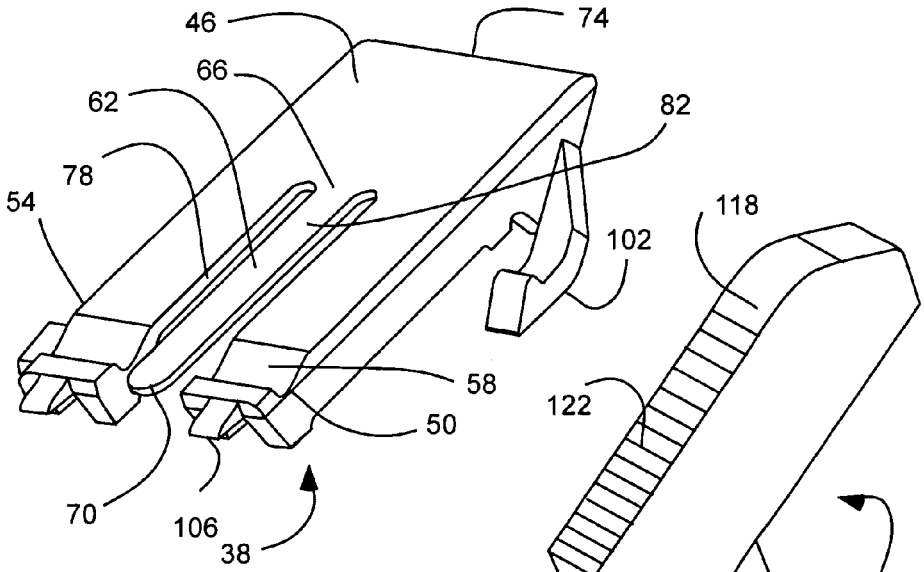
FIG. 1b
FIG. 1c

MEDIA LOADING AND SEPARATION SYSTEM FOR PRINTER

BACKGROUND

Printers, such as ink jet or laser printers, often utilize a stack of paper, or other media stack, from which paper or other media is drawn for printing. Such printers are often equipped with a paper tray to facilitate loading paper into the printer, and/or for correctly positioning the paper for use by the printer. For example, the paper tray can be slid or otherwise removed from the printer; a stack of paper can be inserted into an appropriately sized receptacle in the tray; and then the tray can be slid or otherwise inserted into the printer. The paper tray, however, is an extra part that increases the number of parts and cost of the printer.

Other printers have been developed without paper trays. Such printers often require the user to insert a stack of paper into a slot in the printer. One problem with such printers, however, is that it is often easy for the user to insert the stack of paper incorrectly. It has been observed that often there is no visual or tactile cue to indicate how far to insert the stack of paper. For example, the user can over insert the stack of paper ("over-insertion"), resulting in multi-picks and paper jams. As another example, the user can under insert the stack of paper ("under-insertion"), resulting in failure to pick, excessive skew, or separator jams.

The printers often sequentially draw single sheets of paper from the stack of paper, or other media stack. One problem with picking sheets of paper from the stack is that more than one sheet can be picked ("multiple pick").

BRIEF DESCRIPTION OF THE DRAWINGS

FIG. 1*a* is a perspective view of a media loading and separation system including a spring pick block and a corner media separator in accordance with an embodiment of the present invention shown with a portion of a printer and a media stack;

FIG. 1*b* is a perspective view of a spring pick block of FIG. 1*a;*

FIG. 1*c* is a perspective view of a corner media separator of FIG. 1*c;*

DETAILED DESCRIPTION

Figure 2A:
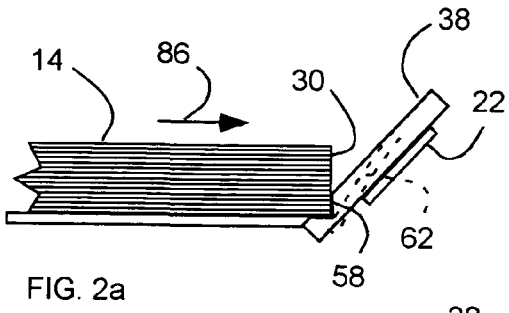
FIGS. 2*a*–2*e* are side schematic views of the spring pick block of FIG. 1*b;*

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1*a*, a media loading and separation system, indicated generally at 10, in accordance with an example embodiment of the present invention is shown for facilitating picking and separation of individual sheets from a media stack 14 of a printer, a bottom portion of which is shown at 18. The media can be any type of media, including for example, paper, card stock, photo paper, and the like. The printer can be any type of printer, including for example, an ink jet printer or laser printer. A top portion of the printer, including print mechanisms and feed mechanisms, has been removed for clarity, leaving only a bottom portion 18 of the printer. The print mechanisms and feed mechanisms are known by those skilled in the art. The printer, or bottom portion 18 thereof, includes a front wall 22 that defines a front or feed end of a media feed area 26. The media feed area 26 receives the media stack 14 with a leading edge 30 of the media stack being received at the front wall 22. The printer can be a "trayless" printer, as shown, so that the media stack 14 can be fed directly into the printer or feed area 26 without the use of a tray. For example, the printer can have a slot or opening 34 in the front through which the media stack is inserted.

The media loading and separation system 10 can include a spring pick block 38, a corner media separator 42, or both. The spring pick block 38 provides a stop to the media stack 14 during insertion of the media stack, while allowing the individual sheets to be picked for printing. The corner media separator 42 can resist multiple picking, and can also resist edge deformation of the edge of the media. The spring pick block 38 and corner media separator 42 can work together to stop insertion of the media stack and facilitate picking. Both the spring pick block 38 and the corner media separator 42 can be disposed at the front wall 22 to engage the leading edge 30 of the media stack 14.

Figure 2B:
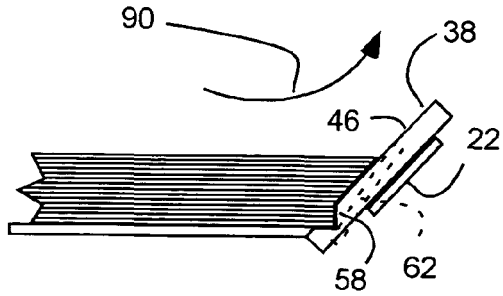

Referring to FIGS. 1*b* and 2*a*–2*e*, the spring pick block 38 includes an inclined surface 46 against which the media stack 14 can abut (FIG. 2*b*). The inclined surface can be substantially planar, and angled or inclined with respect to the media stack. It has been found that an angle θ1 between approximately 25–35 degrees with respect to vertical is appropriate, in some embodiments, for the inclined surface 46. An indentation 50 is formed in the inclined surface 46 near a lower end 54 thereof to receive the leading edge or bottom edge of the media stack. The indentation can be elongated and can extend laterally across the inclined surface, as shown. The indentation 50 includes a substantially vertical surface 58 against which the leading edge 30 or bottom edge of the media stack 14 can abut (FIG. 2*a*). It has been found that an angle θ2 between approximately 0–10 degrees with respect to vertical is appropriate, in some embodiments, for the vertical surface 58.

The spring pick block 38 also includes a spring arm 62 movably disposed with respect to the inclined surface 46 and the indentation 50. The spring arm 62 can have an attached end 66 and a free end 70. The attached end 66 can be secured to the spring pick block 38 or inclined surface 46, while the free end 70 can be substantially free to move. The attached end 66 can be disposed nearer to an upper end 74 of the spring pick block 38 or inclined surface 46, while the free end 70 can be movably disposed nearer the indentation 50 at the lower end 54 of the spring pick block 38.

The spring arm 62 or attached end 66 can be integrally formed with the inclined surface 46 or the spring pick block 38. The spring arm 62 can be formed by a gap 78 formed in the inclined surface 46 of the spring pick block 38, and substantially surrounding the spring arm 62 (except for the attached end 66) so that the spring arm is disposed in the gap. Thus, the spring arm 62 can separate the inclined surface 46 into two surfaces on either side, and can separate the indentation 50 into two indentations on either side, each with a vertical surface.

The spring arm 62, and thus the spring pick block 38 and inclined surface 46, can be formed of a flexible and resilient material so that the spring arm 62 is flexible and capable of bending, but also resilient and capable of storing energy and returning to an unbent position. Thus, the spring arm 62 can have a spring rate that is determined by the length and width of the spring arm, and the material used. It has been found that an acetyl material provides acceptable results, in some embodiments.

Figure 2C:
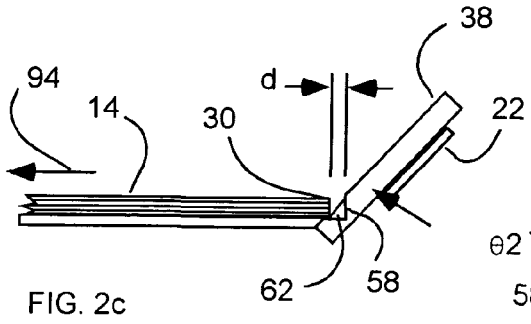
Figure 2D:
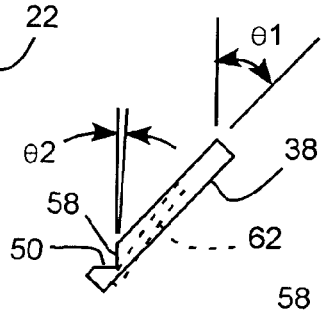
Figure 2E:
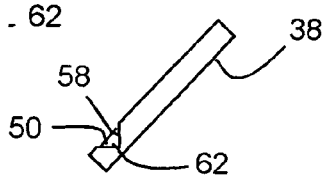
Figure 3A:
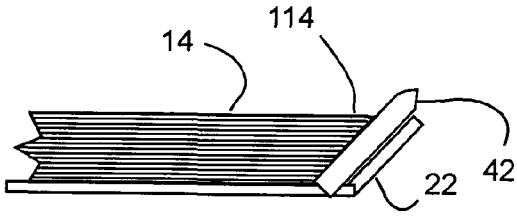
FIG. 3*a* is a side schematic view of the corner media separator of FIG. 1*c*.
Figure 3B:
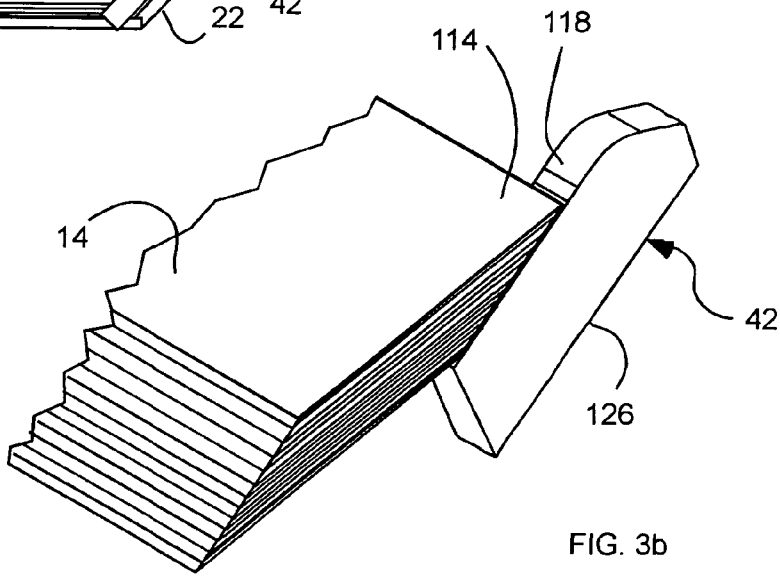
FIG. 3*b* is a perspective schematic view of the corner media separator of FIG. 1*c*.

The spring arm 62 is movable or pivotable between a rearward position, as shown in FIGS. 2*a*, 2*b* and 2*d*, and a forward position, as shown in FIGS. 2*c* and 2*d*. In the rearward position (FIGS. 2*a*, 2*b* and 2*d*), the spring arm 62 is disposed rearward, and can be bent to store energy. The maximum spring arm deflection is controlled by the depth of the indentation 50 or position of the vertical surface 58, which also can restrict its deformation within the elastic range. In the forward position (FIGS. 2*c* and 2*e*), the spring arm 62 is disposed forward, and can be straight without storing energy. The spring arm 62 can have an upper surface 82 that is substantially flush with the inclined surface 46 in the forward position.

The operation of the spring pick block 38 is illustrated in FIGS. 2*a*–2*c*. Referring to FIG. 2*a*, the media stack 14 can be inserted into the printer or media feed area 34 (FIG. 1*a*), indicated by arrow 86, until the leading edge 30 is received into the indentation 50 of the spring pick block 38 or inclined surface 46, and abuts to the substantially vertical surface 58. Thus, the vertical surface 58 provides a media stopping surface and a tactile cue to the user that the media stack has been sufficiently inserted, thus resisting over-insertion. Insertion of the media stack 14 pushes the spring arm 62 to the rearward position, and so that the spring arm 62 bends and stores energy. The media stack 14 as shown in FIG. 2*a* is higher, and thus has sufficient weight, or imposes a greater load, to maintain its position against the vertical surface in the indentation, and to maintain the spring arm 62 in the bent or rearward position. Even with a higher media stack, the whole stack of media can be stopped at the right position when bottom edge of the media stack 14 abuts with vertical surface 58 (FIG. 2*a*).

Referring to FIG. 2*b*, the feed mechanism (not shown) of the printer engages the upper sheet, and can draw the upper sheet forward and upward, indicated by arrow 90. Such feed mechanisms are known to those skilled in the art. The feed mechanism can cause the sheets of the media stack 14 to move forward, against the inclined surface 46 (and against the corner media separator and/or separator pads as discussed below).

Referring to FIG. 2*c*, as the feed mechanism continues to remove sheets from the media stack 14, the size or height of the media stack decreases, as shown. As the media stack is reduced, it becomes a lower media stack and the spring arm 62 overcomes the weight and friction of, or a lesser load imposed by, the lower media stack, and pushes it out of the indentation 50 and away from the vertical surface 58, as indicated by arrow 94. The spring arm 62 moves to the forward position, and pushes the media stack 14 out of the indentation 50 a distance d substantially equal to the depth of the indentation.

When the media stack is reduced to the level of indentation 50 (FIG. 2*c*), the feed mechanism may experience difficulty in picking the upper sheet from the media stack, without the spring arm 62. The spring arm helps to push the lower media stack away from the vertical surface to avoid the no-pick problem.

Therefore, the rearward position of the spring arm 62 corresponds to a higher media stack, or responds to a greater load imposed by media stack insertion or a higher media stack, with the leading edge disposed in the indentation. The forward position of the spring arm 62 corresponds to a lower media stack, or responds to a lesser force imposed by a lower media stack with the leading edge disposed substantially out of the indentation. Thus, the spring arm 62 can move or pivot into and out of the indentation 50.

The spring arm 62 is one example of means for selectively pushing the media stack away from the indentation 50. Other means for selectively pushing the media stack away from the indentation can include, for example, a coil spring, an actuator, etc.

Referring again to FIG. 1*b*, the spring pick block 38 can include one or more attachment arms 102 extending rearward with respect to the inclined surface 46. The attachment arms 102 can form a gap between the arms 102 and the spring pick block 38 to receive the front wall 22 (FIG. 1*a*) therebetween. Thus, the front wall 22 is held between the inclined surface 46 and the attachment arms 102 so that the spring pick block 38 clips onto the front wall 22. In addition, one or more tabs 106 can extend from the lower end 54 of the spring pick block 38 to be received into a corresponding slot in the printer. The attachment arms 102 and/or tabs 106 are one example of an attachment means for attaching the inclined surface, or the device, to the front wall. It is understood that other attachment means can be used, including for example, fasteners, screws, rivets, adhesive, tape, sonic welding, etc.

Referring again to FIG. 1*a*, the corner media separator 42 is disposed at a lateral end 110 of the front wall 22, corresponding to or engaging a corner 114 of the media stack 14. It has been found that the placement of the corner media separator 42 at the corner 114 of the media stack 14 resists deforming the edge of the media. It is believed that the deformation is reduced due to a greater flexibility of the media at the corner.

The corner media separator 42 can include a high friction surface 118 (FIG. 1*c*). The high friction surface 118 creates a higher friction coefficient between the media and the corner media separator 42 to separate the sheets from one another. The high friction surface 118 can be formed by a high friction material, such as rubber, foam or plastic material with texture. In addition, a plurality of horizontal teeth 122 can be disposed on and extend laterally across the high friction surface 118 to further separate the media. The friction surface can create certain friction resistance which is high enough to stop the next to top sheet from moving into the paper path, but also low enough to allow the top sheet to be picked.

The corner media separator 42 is one example of a means for engaging an individual sheet at a corner thereof and separating the individual sheet from the media stack.

The corner media separator 42 can be secured to the front wall 22 with double-sided tape 126. Double-sided tape is one example of a securing means for attaching the corner media separator to the front wall. It is understood that other securing means can be used, including for example, adhesive, sonic welding, fasteners, screws, rivets, etc.

In addition, the spring pick block 38 and the corner media separator 42 can work together. The spring pick block 38 can be disposed on one side of the media stack and front wall, while the corner media separator 42 can be disposed on the opposite side. Thus, both act to stop the media stack on opposite sides.

Referring again to FIG. 1*a*, one or more separator pads 130 can be disposed on the front wall 22 along with inclined front surfaces that engage the leading edge of the media stack to separate the sheets. The front surfaces can be high friction surfaces. The surface 118 of the corner media separator 42 can be offset, in a forward direction, with respect to the inclined front surfaces of the other separator pads 130 by approximately +0.1 mm, so that the surface of the corner media separator is forward or higher than the front surfaces of the other separator pads.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A spring pick block for a printer, comprising:

an inclined surface having a lower end and configured to engage a leading edge of a media stack;

an indentation, formed near the lower end of the inclined surface, having a vertical surface; and a spring arm, movably disposed with respect to the inclined surface, and movable between:

a rearward position in which the spring arm is disposed rearward; and a forward position in which the spring arm is disposed forward.

2. A spring pick block in accordance with claim 1, wherein the spring arm has an attached end secured near an upper end of the spring pick block, and a free end movably disposed near the indentation at the lower end of the spring pick block.

3. A spring pick block in accordance with claim 1, further comprising a gap formed in the inclined surface of the spring pick block; and wherein the spring arm is disposed in the gap and movable into and out of the indentation.

4. A spring pick block in accordance with claim 1, wherein the spring arm is resilient, and bends between the rearward and forward positions.

5. A spring pick block in accordance with claim 1, wherein the inclined surface is disposed at a front wall that defines a feed end of a media feed area configured to receive the leading edge of the media stack.

6. A spring pick block in accordance with claim 5, further comprising:

attachment means for attaching the inclined surface to the front wall.

7. A spring pick block in accordance with claim 6, further comprising:

at least one attachment arm, extending rearward with respect to the inclined surface, with the front wall held between the inclined surface and the at least one attachment arm.

8. A spring pick block in accordance with claim 1, wherein the indentation extends laterally across the inclined surface; wherein the spring arm has an attachment end integrally formed with the inclined surface, a free end pivotally disposed near the lower end of the inclined surface, and an upper surface that is substantially flush with the inclined surface in the forward position.

9. A spring pick block in accordance with claim 1, wherein the inclined surface forms an angle between approximately 25 and 35 degrees with respect to vertical; and wherein the substantially vertical surface forms an angle between approximately 0 and 10 degrees with respect to vertical.

10. A spring pick block in accordance with claim 1, wherein the spring arm is disposed rearward in the rearward position in response to a greater load imposed by a higher media stack with the leading edge disposed in the indentation; and wherein the spring arm is disposed forward in the forward position in response to a lesser load imposed by a lower media stack with the leading edge disposed substantially out of the indentation.

11. A spring pick block in accordance with claim 1, wherein the inclined surface is oriented at an obtuse angle with respect to the media stack.

12. A spring pick block in accordance with claim 1, wherein:

the spring arm is positioned behind the indentation in the inclined surface in the rearward position and corresponds to a higher media stack;

the spring arm is positioned substantially flush with the inclined surface in the forward position and corresponds to a lower media stack.

13. A device for facilitating picking of individual sheets from a media stack of a printer, comprising:

an inclined surface defined by being engageable with a leading edge of a media stack and oriented at an obtuse angle with respect to the media stack, and having a lower end;

an indentation, formed near the lower end of the inclined surface; and means for selectively pushing the media stack away from the indentation.

14. A device in accordance with claim 13, wherein the means for selectively pushing is disposed rearward in a rearward position in response to a greater load imposed by a higher media stack with a leading edge disposed in the indentation; and wherein the means for selectively pushing is disposed forward in a forward position in response to a lesser load imposed by a lower media stack with the leading edge disposed substantially out of the indentation.

15. A spring pick block for a printer, comprising:

an inclined surface having a lower end and engageable with a leading edge of a media stack;

an indentation, formed in the lower end of the inclined surface and oriented to face the media stack, to receive a bottom edge of the media stack and having a vertical surface engageable with a leading edge of the media stack; and a spring arm, movably disposed with respect to the inclined surface, and movable between a position behind the indentation and a position substantially flush with the inclined surface.

16. A spring pick block in accordance with claim 15, wherein the spring arm has an attached end secured near an upper end of the spring pick block, and a free end movably disposed near the indentation at the lower end of the spring pick block.

17. A spring pick block in accordance with claim 15, further comprising a gap formed in the inclined surface of the spring pick block; and wherein the spring arm is disposed in the gap and movable into and out of the indentation.

18. A spring pick block in accordance with claim 15, wherein the spring arm is resilient, and bends between the rearward and forward positions.

19. A spring pick block in accordance with claim 15, wherein the inclined surface is disposed at a front wall that defines a feed end of a media feed area configured to receive the leading edge of the media stack.

20. A spring pick block in accordance with claim 19, further comprising:

attachment means for attaching the inclined surface to the front wall.

21. A spring pick block in accordance with claim 20, further comprising:

at least one attachment arm, extending rearward with respect to the inclined surface, with the front wall held between the inclined surface and the at least one attachment arm.

22. A spring pick block in accordance with claim 15, wherein the indentation extends laterally across the inclined surface; wherein the spring arm has an attachment end integrally formed with the inclined surface, a free end pivotally disposed near the lower end of the inclined surface, and an upper surface that is substantially flush with the inclined surface in the forward position.

23. A spring pick block in accordance with claim 15, wherein the inclined surface forms an angle between approximately 25 and 35 degrees with respect to vertical; and wherein the substantially vertical surface forms an angle between approximately 0 and 10 degrees with respect to vertical.

24. A spring pick block in accordance with claim 15, wherein the spring arm is disposed rearward in the rearward position in response to a greater load imposed by a higher media stack with the leading edge disposed in the indentation; and wherein the spring arm is disposed forward in the forward position in response to a lesser load imposed by a lower media stack with the leading edge disposed substantially out of the indentation.

25. A spring pick block in accordance with claim 15, wherein the inclined surface is oriented at an obtuse angle with respect to the media stack.

26. A spring pick block for a printer, comprising:

an inclined surface defined by being engageable with a leading edge of a media stack and oriented at an obtuse angle with respect to the media stack, the inclined surface having a lower end;

an indentation, formed in the lower end of the inclined surface and oriented to face the media stack, to receive a bottom edge of the media stack and having a substantially vertical surface engageable with a leading edge of the media stack; and a spring arm, movably disposed with respect to the inclined surface, and having an upper surface that is substantially flush with the inclined surface in one position, and movable to another position behind the indentation.

* * * * *